US006345969B1

(12) United States Patent
White

(10) Patent No.: US 6,345,969 B1
(45) Date of Patent: Feb. 12, 2002

(54) INCREASED CAPACITY VALVING PLATES FOR A HYDRAULIC MOTOR

(75) Inventor: Hollis Newcomb White, Hopkinsville, KY (US)

(73) Assignee: White Hydraulics, Inc., Hopkinsville, KY (US)

( * ) Notice: Subject to any disclaimer, the term of this patent is extended or adjusted under 35 U.S.C. 154(b) by 0 days.

(21) Appl. No.: 09/605,284

(22) Filed: Jun. 28, 2000

(51) Int. Cl.[7] ..... F03C 2/00
(52) U.S. Cl. ..... 418/61.3; 418/133
(58) Field of Search ..... 418/61.3, 133

(56) References Cited

U.S. PATENT DOCUMENTS 3,601,513 A * 8/1971 White, Jr. ..... 418/61.3
3,616,882 A * 11/1971 White ..... 418/181
3,894,821 A * 7/1975 White, Jr. ..... 418/133
4,474,544 A * 10/1984 White, Jr. ..... 418/61.3
4,981,423 A * 1/1991 Bissonnette ..... 418/61.3
5,135,369 A * 8/1992 White, Jr. ..... 418/61.3

* cited by examiner

*Primary Examiner*—Thomas Denion
*Assistant Examiner*—Theresa Trieu
(74) *Attorney, Agent, or Firm*—Lightbody Law Office

(57) ABSTRACT

A hydraulic gerotor motor utilizing the holes surrounding the main assembly bolts together with interconnecting radially extending passages so as to allow for the transfer of fluid axially through the device from a single fluid input hole to an area 360° surrounding a valve.

31 Claims, 6 Drawing Sheets

INCREASED CAPACITY VALVING PLATES FOR A HYDRAULIC MOTOR

FIELD TO WHICH THE INVENTION RELATES

This invention relates to a series of plates for a hydraulic motor which improve the volumetric efficiency of the motor.

BACKGROUND OF THE INVENTION

Hydraulic motors have been utilized to provide power to a negative mechanism (such as a motor for a drivewheel or winch) or to derive power from a positive mechanism (such as a fluid pump driven by a gasoline motor). In some instances, the device is also utilized for a secondary purpose such as controlling the speed of rotation of itself or an auxiliary member.

Most hydraulic devices are relatively large in diameter for a given volumetric efficiency. The reason for this is the constraints in the cross-sections of the fluid passages which are necessary in the body of such hydraulic device. Examples of devices with limited cross-sectional passages include the Ross Gear MF-MG series which include a separate series of set diameter holes interconnected in alternate plates by set diagonal passages to provide for a fluid path axially through the manifold between (and separately from) the main bolts. In this Ross device both the holes and lateral slots have limited cross-sections, thus limiting the amount of fluid which is able to pass axially through the manifold. Some devices partially neighbor a bolt—examples include the bi-directional valving passage in U.S. Pat. No. 5,173,043, Reduced Size Hydraulic Motor, and the uni-directional passages in U.S. Pat. No. 3,452,680, Hydraulic Motor Pump Assembly and U.S. Pat. No. 3,452,543, Hydrostatic Device. However this usage is limited to a single location surround (U.S. Pat. No. 5,173,043) or a symmetrical Passageway (U.S. Pat. Nos. 3,452,680, 3,452,543).

SUMMARY OF THE INVENTION

It is an object of this invention to increase the volumetric efficiency of a given diameter hydraulic motor.

It is an object of this invention to utilize areas neighboring bolts to provide fluid passages for the device.

It is an object of this invention to utilize the inside surface of bolts to physically locate parts in respect to each other.

It is a further object of this invention to reduce the cost of motors.

It is another object of this invention to lower the heat generated by hydraulic motors.

It is yet another object of this invention to facilitate the manufacturer of hydraulic motors.

It is still a further object of this invention to lower the tolerances in hydraulic motors.

Other objects of the invention and a more complete understanding of the invention may be had referring to the drawings in which:

DETAILED DESCRIPTION OF THE INVENTION

Figure 1:
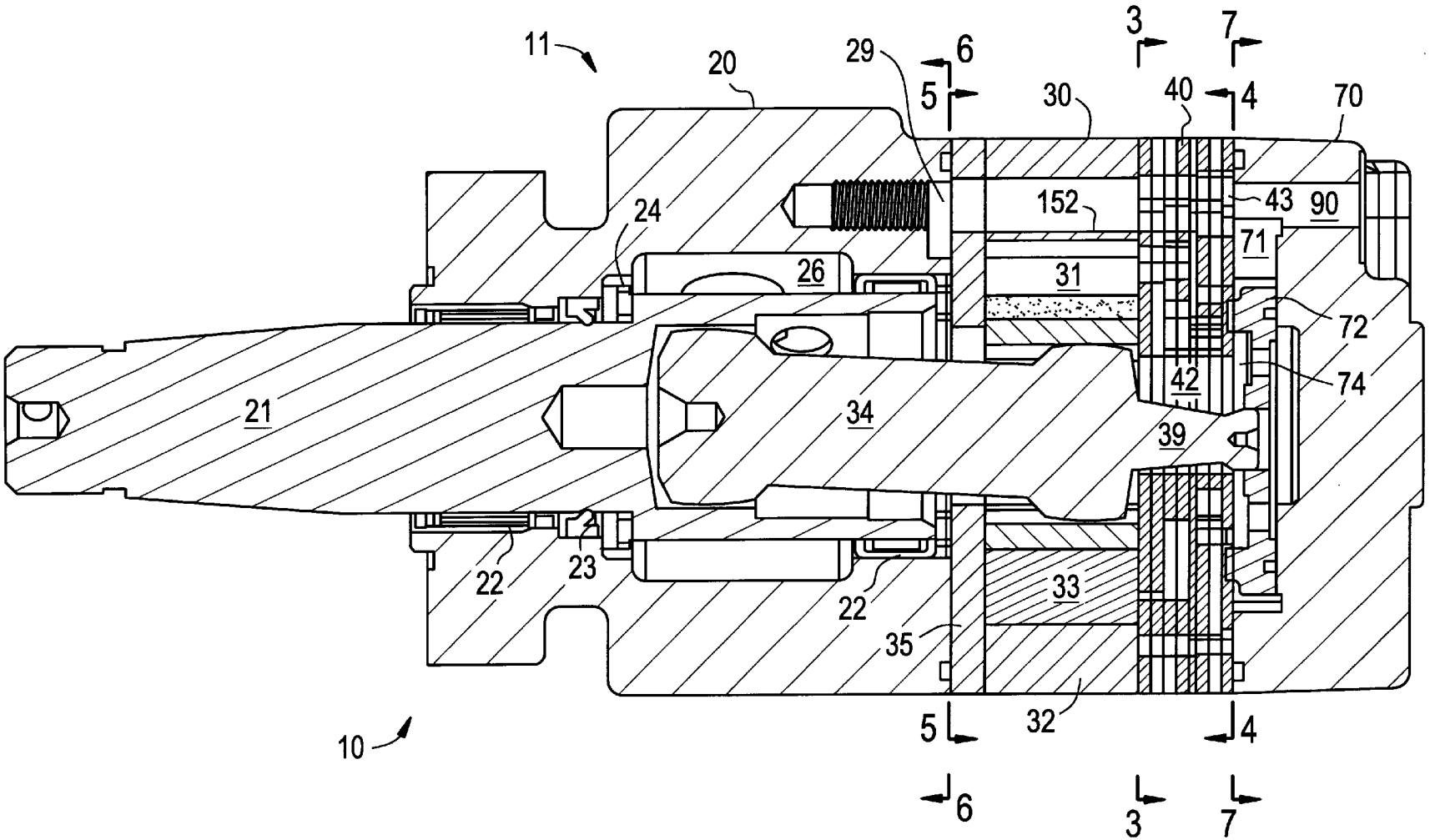
FIG. 1 is a cross-sectional side view of a hydraulic motor incorporating the invention.
Figure 2:
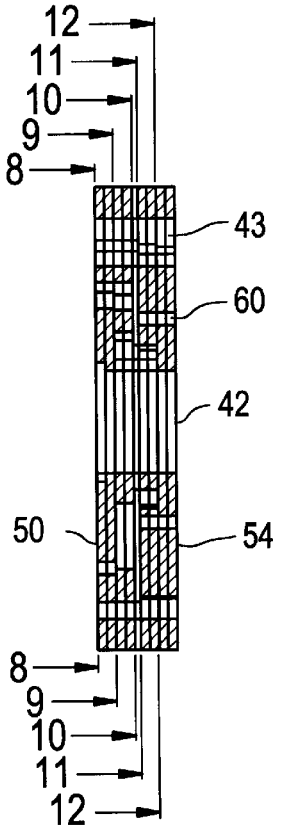
FIG. 2 is a side view of the manifold of the motor of FIG. 1.
Figure 3:
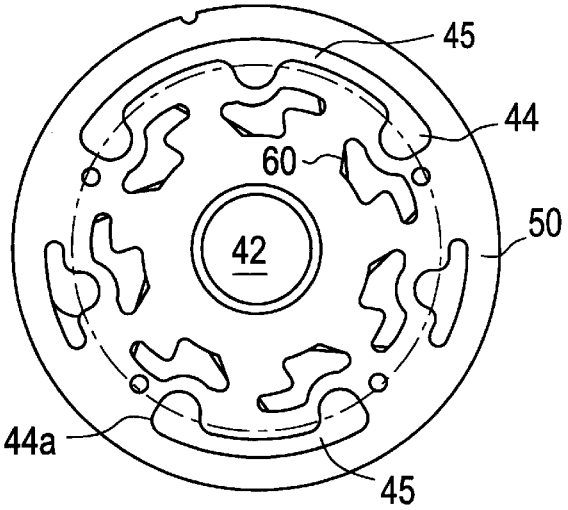
FIG. 3 is an end view of the manifold of FIG. 2, taken along lines 3—3 in FIG. 1 which side would ordinarily face the rotor of the hydraulic device.
Figure 4:
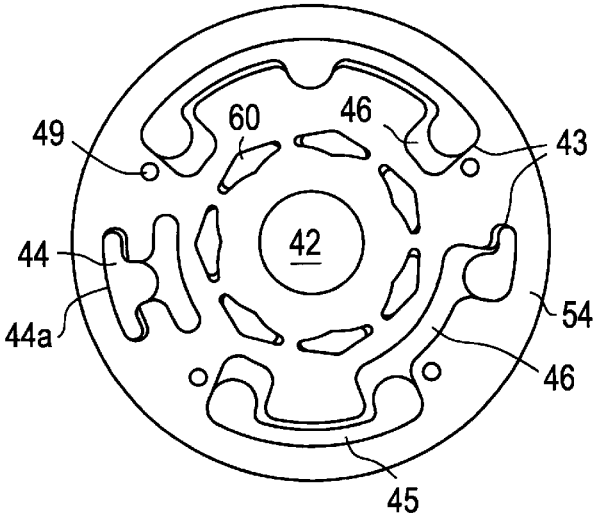
FIG. 4 is an end view of the manifold of FIG. 2, taken along lines 4—4 in FIG. 1 which side would ordinarily face the valve of the hydraulic motor.

This invention relates to an improved pressure device with increased volumetric efficiency. The invention will be described in its preferred embodiment of a gerotor motor having an orbiting valve separate from the rotor.

This invention relates to an improved fluid passageway for a gerotor pump/motor 10 (a pump supplies fluidic power on rotation of a shaft while a motor supplies rotation of a shaft on application of fluid pressure—a single device can do both).

The gerotor motor 10 has a housing 11 including a bearing port section 20, a gerotor structure 30, a manifold 40 and an end plate 70.

The housing 11 includes all of the parts of the gerotor motor 10. Its purpose is to locate the various fixed and movable parts in their operative positions in respect to each other. It also provides for a method of locating the gerotor motor onto an external structure as well as providing for the necessary fluidic interconnections thereto.

The bearing port section 20 rotatively supports the driveshaft 21 in respect to the housing in addition to providing for a specific location for the two fluid ports 27, 28 for the device. The ports could be located otherwise if desired (including one or both in the end plate 70) as long as the ports communicate with the valve as hereinafter set forth.

The driveshaft itself 21 is a generally cylindrical shaft supported by two needle bearings 22 to the surrounding section 20. A main seal 23 retains the hydraulic fluid within the housing 11 while a thrust bearing 24 against a shoulder of the driveshaft prevents the extrusion of the driveshaft upon the pressurization of the central cavity 26 containing the driveshaft. If the device is a closed center device such as shown in U.S. Pat. No. 5,135,269, has a case drain such as shown in U.S. Pat. No. 5,165,880 (both incorporated by reference) or otherwise has an unpressurized case the main seal requirements are reduced.

The ports 27, 28 serve to interconnect the gerotor motor to a source of pressure and return via hydraulic lines (not shown). The use of the ports on the bearing/port section 20 allow for the maintenance of the remainder of the gerotor motor without the removal of the entire unit from its associated component (such as a frame for a wheel drive or winch drive). The location also serves to physically protect such fluid interconnections from mechanical damage by locating them neighboring structural members of the associated device.

Figure 6:
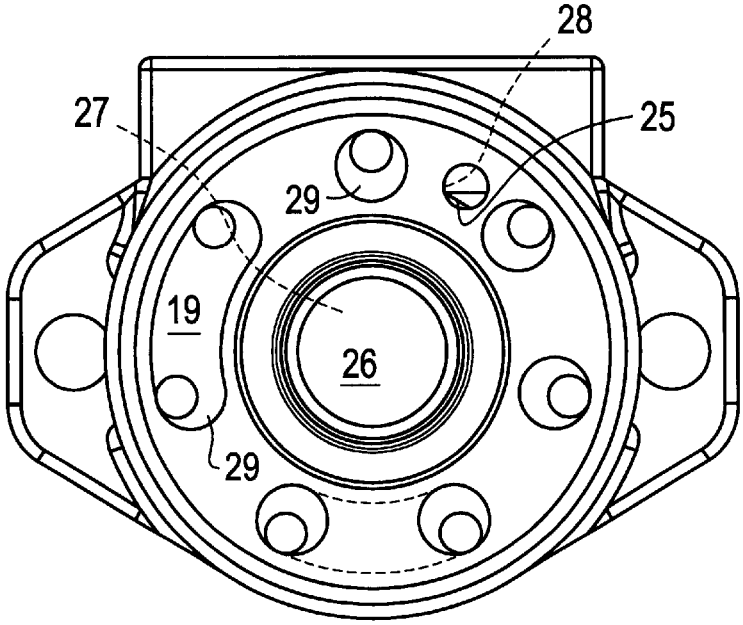
FIG. 6 is an end view of the bearing port section of FIG. 1 taken generally from lines 6—6 therein.
Figure 7:
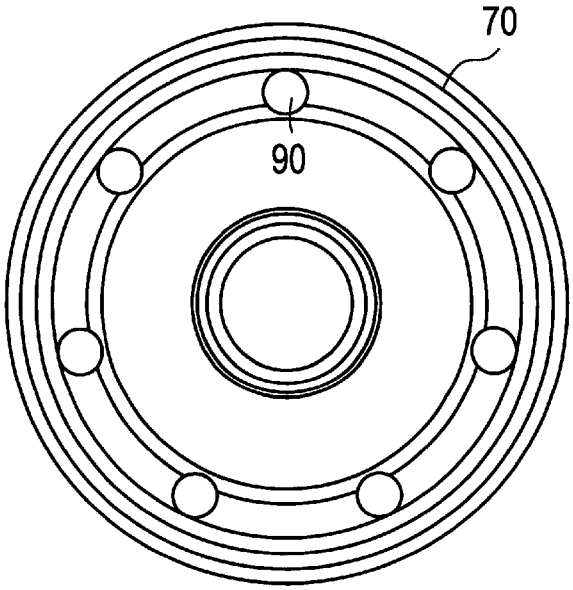
FIG. 7 is an end view of the end cover taken from lines 7—7 in FIG. 1.

In the embodiment disclosed, one port 27 is interconnected to the central cavity 26 of the bearing port section 20 while the other port 28 is interconnected to a hole 25 which extends to the rear face of such section 20 (purpose later set forth—FIG. 6. These two connections ultimately operatively connect respectively to the operative opposing sides of the valve.). Enlarged holes 29 surround each tapped bolt hole in the rear surface of the bearing section 20. These holes 29 provide for an increased area for fluid passage about the bolts 90. In addition the section 20 includes part of the 360° fluid connection in the remainder of the device.

In the embodiment disclosed, the housing 11 is 3.4" long with a diameter of approximately 3.62" with the seven tapped bolt holes some 0.272" in diameter equally spaced and located on a 2.8" bolt circle. The bolt holes themselves are approximately 1" deep and tapped to engage the threaded end of the bolts (5/16"×24 UNF thread). The threaded engagement between the bolts 90 and bearing/port section 20 retain the bolts in position with the housing 11. The enlarged holes 29 in the housing 11 surrounding each bolt hole are ½" diameter located on a 2.63" bolt circle with their axis offset from the seven bolt holes. The hole 25 extending to the port 28 is approximately 5/16" diameter 0.313 deep positioned approximately 60° from the lateral axis on an approximately 1.35 radius. The groove 19 is milled 0.20 deep between at least two holes 29. Multiple segmented grooves or a continuous 360° groove could be utilized if desired.

The gerotor structure 30 is the main power development element for the gerotor motor 10. The particular gerotor structure 30 disclosed includes an orbiting rotor 31 located within a fixed stator 32 as is known in the art. The internal teeth of the stator 32 are formed by cylinders 33 captured in semi-circular cavities within such stator 32. This allows for the efficient manufacture of the stator as well as slightly increasing the mechanical efficiency of the gerotor structure. A wobblestick 34 serves to drivingly interconnect the rotor 31 to the driveshaft 21 by a toothed interconnection with each in a conventional manner.

The particular stator has seven holes in it approximately 0.38" in diameter on a 2.845" diameter bolt circle. These holes cooperate with the holes 29 in the port section 20 in order to feed fluid to the passages 43 in the later described manifold 40. The inside extent of these holes 152 cooperate with the inside surface of the bolts 90 to physically locate the stator 32 in position in respect to the housing 11. This is preferred in that the bolt/stator contact is in compression and/or shear in close proximity to the location of force generation (the pressure cells). This avoids the flexing unequal elongation that is present in a device having contact outside of the bolts 180° from the location of force contact. The rotor/stator side clearance is on the order of 0.001".

A wear plate 35 on one side of the gerotor structure 30 and a manifold 40 on the other side of the gerotor structure serve to seal the two axial ends of the gerotor structure, thus to finish the definition of the expanding and contracting gerotor chambers located between the rotor and the stator. They also serve to distribute fluid to and from the gerotor structure.

Figure 5:
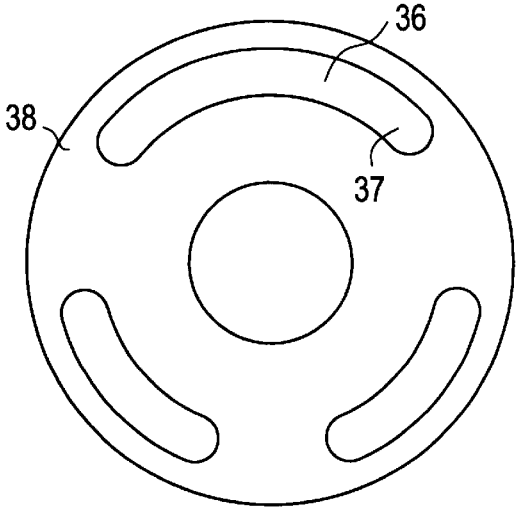
FIG. 5 is a cross-sectional view of the wear plate of FIG. 1 taken generally from lines 5—5 therein.

The wear plate 35 is of conventional construction except for the fact that it has slots 36 extending between the bolt holes 37 therein (FIG. 5). The slots 36 allow for fluid passage between and to the bolt holes 37 through the wear plate 35 (as later described). The webs 38 interrupting the slots 36 provide for structural integrity of the wear plate center area (and also allow for the convenient handling of the part). By overlaying the wear plate (FIG. 5) on the bearing/port section (FIG. 6) it can be seen that at the wear plate the fluid from the hole 25 is distributed for a significant distance about the circumference of the device (360° with the addition of a second groove 19—dotted lines the bottom of FIG. 6).

The particular wear plate is approximately 3.735" in diameter and 0.22" thick. A 1.2" hole is located in its center. There are three 0.36" width discontinuous grooves equally spaced on a 2.83" circle around the outer circumference of the wear plate. At least one of the webs 38 between the slots 36 is preferably fluidically bypassed by the groove 19 in the housing 11 (and/or passages in manifold 40). The two slots 36 shown extend between the bolt holes 37 approximately for 51.5° and a third 102.8° through the full depth of the wear plate. In the embodiment disclosed there is again inside contact between the bolt holes 37 and the bolts 90 to locate the wear plate 35.

The main emphasis of the invention of the present application are the fluid passages which extend through the multi-plate manifold 40 between the port 28 and the valving area 71 outside of the orbiting valve 72 contained within the endplate 70 (the valve 72 itself is orbited by a extension 39 off of the wobblestick with the central opening 74 in such valve interconnected to the other port 27 via the central cavity 26 and the passageway 42 through the center of the rotor and manifold).

The manifold 40 is important in the preferred gerotor motor in that it serves three major purposes:

The first purpose is to transfer fluid continuously from the two ports 27, 28 to the valving area 71 and central opening 74 of the valve 72. This continual commutation demands an unimpeded fluid passage through the manifold via openings, preferably at least as large as the later described valving passages in order to not impede the volumetric efficiency of the gerotor motor. This dual fluid connection requires two separate sets of fluid passageways in the manifold 40.

The second purpose of the manifold 40 is to interconnect the valving area 71 and central opening 74 of the valve 72 selectively to the expanding and contracting gerotor cells of the gerotor structure 30 as the device is operated. This valving operates through a single set of bi-directional passageways extending also in the manifold 40.

The third purpose of the manifold is to provide physical room for the orbiting offset of the valve from the rotor 31 and the rotational axis of the driveshaft 21.

In respect to the first purpose, the interconnection between the port 27 to the central opening 74 of the valve 72 in the embodiment disclosed is a simple hole 42, which hole extends straight through the manifold 40 from one side to another. The size of this central hole is sufficient so as to not serve to impede fluid flow through the gerotor motor while at the same time being small enough so as to not interfere with either the other passages in the manifold or to interconnect the central opening 74 with the valving area 71 bi-passing the valve 72. By having the hole in the manifold plate immediately laterally adjoining the wobblestick 34 larger than the next plate there is an increased clearance for the wobblestick (as well as an additional surface edge for the localization of the wobblestick).

The interconnection between the other port 28 and the valving area 71 through the manifold 40 is of a more unique configuration. A reason for this is that the passages 43 incorporate the areas 44 about the bolts 90, intermediate areas 45 and internal areas 46.

Figure 13:
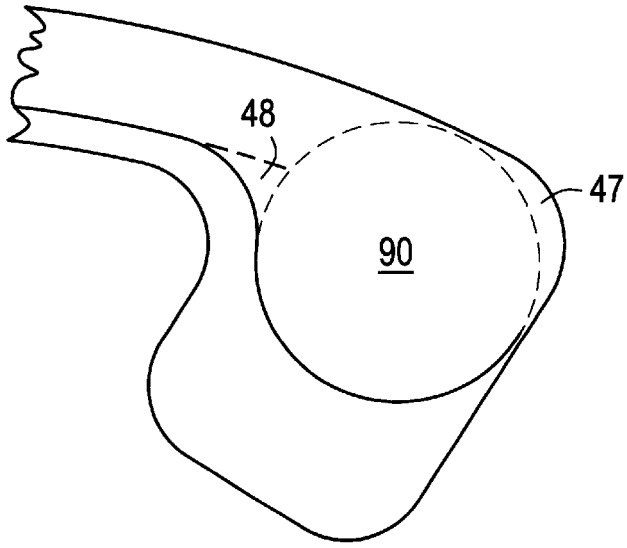
FIG. 13 is an enlarged view of a part of FIG. 4 detailing the areas providing fluid passages surrounding the bolts holding the device together.

The utilization of the areas 44 surrounding the bolts 90 for the passage of fluid enables the manifold 40 to have a smaller diameter than if a separate passage(s) was incorporated outside of the diameter of the bolt circle while not compromising volumetric efficiency, physical strength and/or longevity (as separate radially offset passages might produce). In the particular embodiment disclosed, the areas are created mostly by extending the edges of the bolt holes radially of the diameter of the bolts (FIG. 13). This is accomplished in the preferred embodiment by using radii different than that of the bolt spaced from the axis of such bolt to provide for areas adjacent to the outer diameter of such bolts. There is preferably always at least some contact between the bolts and the various plates that make up the manifold at the inner (and preferably also outer) sides of the bolts 90 so as to allow the bolts to physically retain the manifold 40 in place and intact against high pressure (because the manifold is typically brazed, this contact serves to strengthen the interconnections between the plates thus allowing the use of smaller surfaces for brazing between plates). In the embodiment disclosed, this contact arranges from less than 10° on a surface (as at 44*a*) to substantially 180° contact (as at 44*b*). It is preferred that each bolt include both an inside and outside contact so as to retain the associated parts in their designed position. In this respect, it is noted that while some contact is shown in all plates to all bolts, contact therebetween can be omitted to individual bolts and/or plates as long as there is sufficient contact between the totality of bolts and the entire manifold 40 so as to retain same in physical position in respect to the housing 11 and gerotor structure 30 at the desired pressure range. Again inner contact equally spaced 360° about the device is preferred so as to contain the otherwise outward forces existent in the device with a compression type load near to the generation of forces.

The intermediate areas 45 serve to pass the fluid through the manifold 40 in addition to aiding in equalizing the fluid flow and pressure circumferentially about the manifold by bridging the webs 38 in the wear plate 35 and other webs between passages in the manifold plates. These intermediate areas 45 preferably interconnect at the outside bolt radius in order to maximize the distance between these intermediate areas and the later described valving passages (and the pins 49).

The internal areas 46 serve to pass the fluid from the bolt circle and intermediate areas 45 to an inside area including the valving area 71 immediately surrounding the valve 72. This facilitates the passage of fluid from the holes 44 to this valving area 71. Preferably, the internal extent of the internal areas 46 is defined by the outer diameter of the valve 72 as it contacts the manifold 40—any further internal extension would be covered by the valve and be of no substantive effect.

Figure 11:
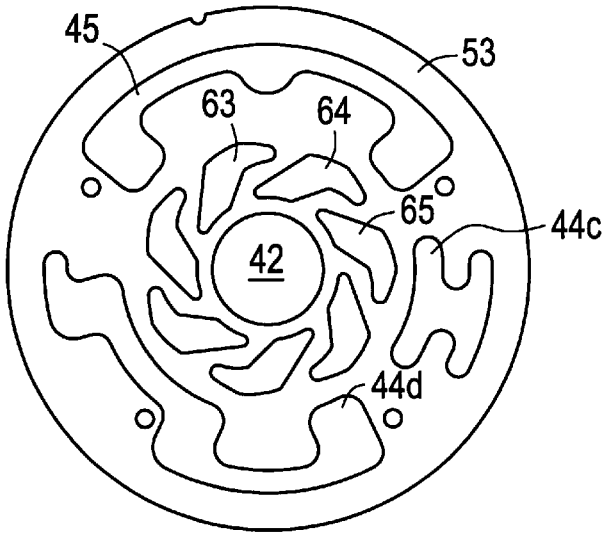

In all instances, preferably there is a significant overlap between the passages to the various plates to allow for the relative free passage of fluid therebetween. This allows for pressure and fluid flow equalization about the device. It is not necessary that the intermediate areas 45 be all symmetrically interconnected as long as in total they cooperate to further extend the fluid 360° about the valve 72 from the initial single hole 25 (contrast 44*c* with passage 44*d* in FIG. 11).

The manifold itself is some 3.7" in diameter and 0.60" thick. The manifold is made up of a stack of eight plates pinned together by four 0.125" diameter pins 49 located on a 2.750" bolt circle prior to brazing. These pins localize the plates in respect to each other during the brazing operation as well as serving to allow for the radial forces to be more efficiently passed therein. In addition the various openings and passages 43–45 in the manifold 40 cooperated in total with the bolts 90 to physically localize the manifold 40 in respect to the housing while simultaneously creating fluid openings for the distribution of fluid from the hole 25 to the area 71 surrounding the valve 72. This occurs because of the unimpeded areas in the various plates 50–54 that make up the openings in the manifold. The bolts 90 again preferably contact the inside surfaces of the manifold 40 to locate same.

The cell opening plate 50 is some 3.7" in diameter and 0.075" thick (0.150" for the pair shown). Each plate 50 includes seven equally spaced holes some 0.322" in diameter located on a 2.80" bolt circle. Five of the holes are interconnected by a 0.135" wide web beginning at a 1.475" inside diameter. The inside connections between the holes and webs and the outside outer ends of the holes are extended to 0.188" (from 0.158" with 0.125" radiused ends) to provide for a set of interior inside passages 81 and exterior outside passages 80 about these holes. As can be seen from FIG. 13 the extension and radiusing of the ends of the holes provides for an outer passage 47 and an inner passage 48 that would not exist had the web 45 directly interconnected with holes the diameter of the bolts 90 (the holes shown are 0.325" diameter containing 0.315" diameter bolts both on a 2.80" bolt circle). Two other holes have a 0.75" extension some 0.135" wide on the same inner diameter with 0.068" radius ends extending bi-directionally thereof. The center hole is 0.95" in diameter in the outer plate and 0.80" in the inner plate.

The internal shift plate 51 is some 3.7" in diameter and 0.075" thick (0.150" for the pair shown). The holes in the internal shift plate 51 are some 0.380" in diameter spaced on a 2.845" bolt circle. The seven holes are again equally spaced, again with a 0.135" interconnecting web on a 1.475" inner diameter and two holes with a 0.75" extension (again with radiused inside and outside ends). The center hole is 0.80" in diameter.

The connection plate 52 is 3.7" in diameter and 0.042" thick. It has a series of 0.380" diameter holes on a 2.845" bolt circle again connected by a 0.135" wide web on a 1.475" inner diameter and with the 0.75" extensions (with radiuses) and a 0.80" diameter inner hole.

The external shift plate 53 is 3.7" in diameter and 0.075" thick (0.150" total). The plate 53 has a series of 0.380" diameter holes spaced on a 2.845" bolt circle. Five of the bolt holes are interconnected by a 0.172" wide web on a 1.435" inner diameter with radiused ends. There is an inner extension extending off of six of the bolt holes some 0.43" wide extending inward to a 1.04" inner radius. Two of these inward extensions are connected by a 0.19" wide web extending outward from a 1.04" inner diameter while a separate extension extends in respect to an additional bolt hole some 0.75" long. All edge radii are 0.125".

The valving plate 54 is 3.7" in diameter and 0.075" thick. It has a series of 0.380" diameter holes located on a 2.845" bolt circle. These holes are interconnected by a 0.175" wide web with a 1.435" inner diameter for the outward passages and a 0.19" web and 1.040" diameter for the inner passages. Again, the inward extensions are 0.43" wide extending inward to a 1.04" inner diameter and all edges are radiused to 0.125".

The valving passages 60 are designed to minimize the restrictiveness of their opening to a single set of crossover openings 67 in the center of the manifold 40.

The valve openings 61 are designed for a smooth transition between fluid connections in an orbiting valve type design. Towards this end the inner edge of a chosen valving opening blends in with the outer edge of an adjacent opening, thus to provide for a smooth transition in the valving process.

The external shift passages 63 and the external shift plate 53 begin with an outer section 64 which substantially matches that of the valving passages 61. The internal section 65 of these same passages extend inwards toward the central opening 42 without a reduction in cross-sectional area while at the same time providing sufficient distance between adjacent passages that there is a proper sealing therebetween.

The crossover openings 67 in the connection plate 52 include the entire area which is common to both the external shift passages 63 and the later described internal shift passages 68. These crossover openings 67 are thus the maximum cross-sectional size they can be effectively while still efficiently transferring fluid between the external shift passages 63 and the internal shift passages 68.

The internal shift passages 68 in the internal shift plate 51 extend for the greatest distance they are thus the largest passages within the manifold 40. The inner end 69 of the internal shift passages 68 match that of the crossover openings 67 while the outer ends 70 substantially replicate the expanding/contracting gerotor cells of the gerotor device. Again, these internal shift passages 68 are designed with a minimum clearance therebetween so as to maximize the size of such passages.

The cell openings 171 in the cell opening plate 50 include a main section 172 which is substantially centered on the expanding/contracting gerotor cells. A small additional extension 73 provides for auxiliary lubrication of the cylinders 33 in the gerotor motor by extending substantially to the center of the area off of axial ends of such cylinders 33. Again, the size of these cell openings 171 substantially overlap the internal shift passages 68 so as to provide for the efficient fluid passage therebetween.

In order to further increase the amount of fluid passing through the manifold, the cell opening plate 50, the internal shift plate 51 and the external shift plate 53 are used in multiples, thereby to increase the cross-sectional area of the valving passages 60 extending therein, thus to further increase the volumetric efficiency of the gerotor motor.

The end plate 70 completes the housing 11 by aiding to seal the area 71 surrounding the valve 72 against the manifold 40. The end plate is substantially 3.6" in diameter and 1.17" long with a series of 0.315" diameter holes on a 2.8" bolt circle for the bolts 90.

Figure 8:
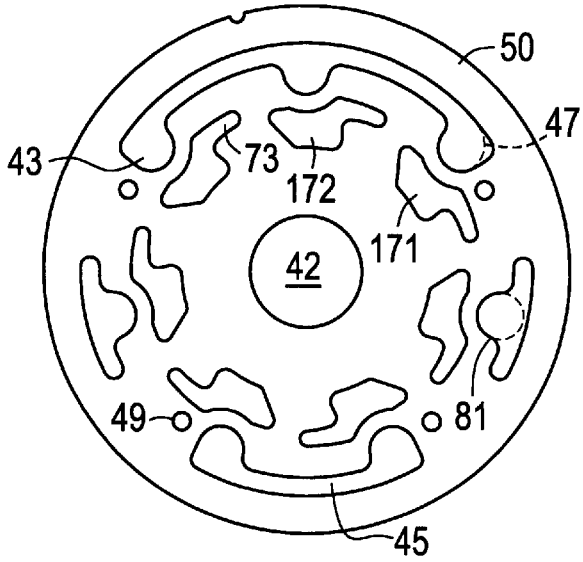
FIG. 8–12 are sequential cross-sectional views of the various plates utilized to make up the manifold of FIG. 2.
Figure 9:
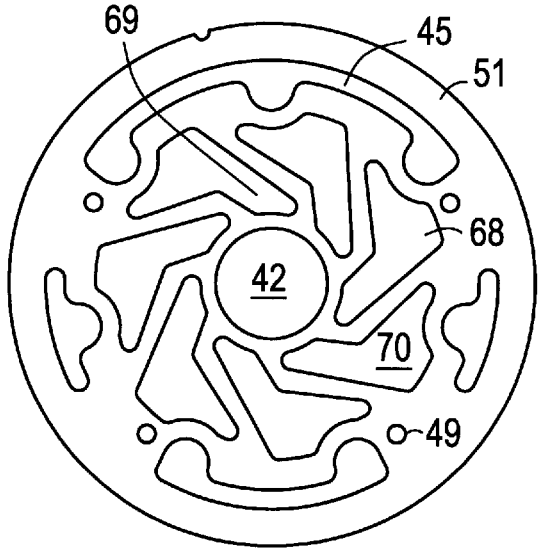
Figure 10:
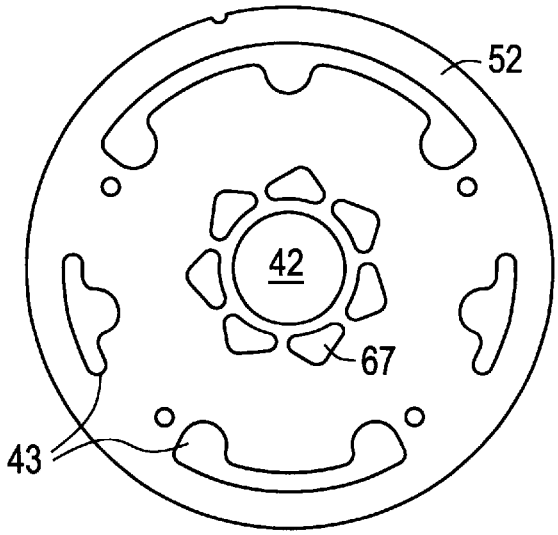
Figure 12:
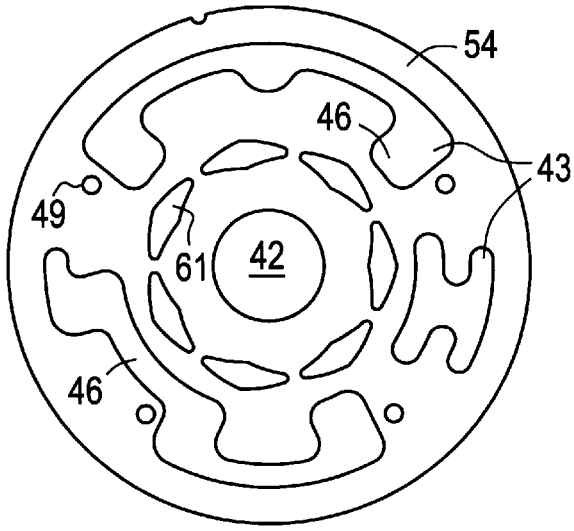
Figure 14:
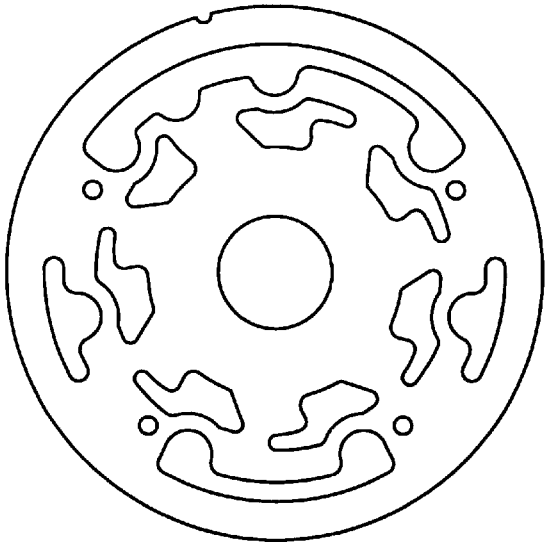
FIG. 14–17 are modified cross-sectional views of FIGS. 8, 9, 11, and 12 showing optional modification to provide for 360° transfer of fluid within the manifold.
Figure 15:
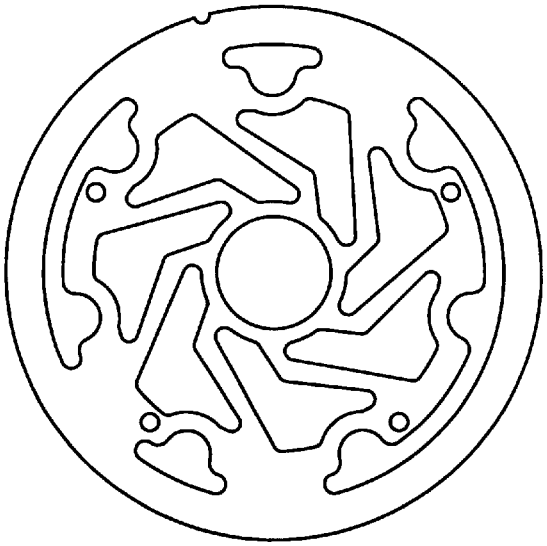
Figure 16:
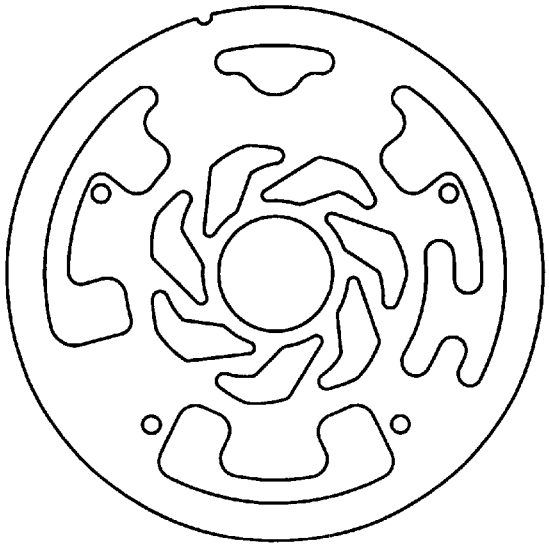
Figure 17:
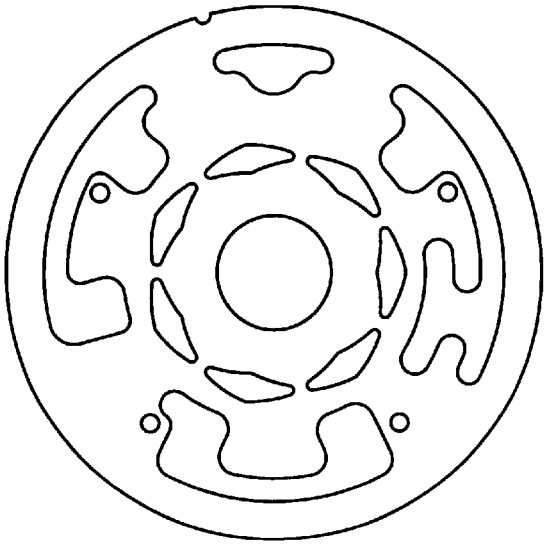

Although this invention has been described win its preferred form with a certain degree of particularity, numerous changes can be made without deviating from the following claimed invention. For example an inside contact between the bolts 50 and the various openings 43–45 in the manifold 40 are utilized to retain the manifold in position in respect to the remainder of the housing 11. If desired outside contact, a combined inside/outside contact, a limited number of dedicated through bolts or other contacts could be utilized without deviating from this invention. Additional example the passages within the manifold can be modified to provide for a 360° transfer of fluid entirely within the manifold. This could be accomplished by modifying the two plates 50, 51 (FIGS. 8 and 9) as plates 150, 151 (FIGS. 14 and 15) and/or the plates 53, 54 (FIGS. 11 and 12) as plates 153, 154 (FIGS. 16 and 17). It is not preferred to modify the cross-over plate 52 due to the single thickness limited available area in this plate. Other changes are also possible.

What is claimed:

1. A fluid passage for a manifold having bolts extending through holes therein, the fluid passage comprising a radially extended area, said radially extended area extending off of a first portion of at least one hole surrounding a bolt, said at least one hole having a second portion surrounding said bolt, said second portion of said hole having an inner surface and said inner surface of the second portion of said hole being in contact with the bolt.

2. A fluid passage for a manifold having bolts extending through holes therein, the fluid passage comprising a radially extended area, said radially extended area extending off of at least one hole surrounding a bolt, there being two adjoining holes with radially extended areas and two radially extended areas of said two adjoining holes forming an interconnection passage connecting same, said at least one hole surrounding a bolt having an inner surface and said inner surface being in contact with the bolt.

3. The fluid passage of claim 2 characterized in that said interconnection passage connects the outer extent of said two adjoining holes.

4. A fluid passage for a manifold having bolts extending through holes therein, the fluid passage comprising a radially extended area, said radially extended area extending off of at least one hole surrounding a bolt, said at least one hole having two radially extended areas, said two radially extended areas extending symmetrically in opposing radial directions, said at least one hole surrounding a bolt having an inner surface and said inner surface being in contact with the bolt.

5. The fluid passage of claim 4 characterized in that said two radially extended areas extend off of the outer extent of said at least one hole.

6. A fluid passage for a manifold having bolts extending through holes therein, the fluid passage comprising the holes surrounding the bolts, an interconnection passage, said interconnection passage connecting two of the holes, and the fluid passage including said interconnection passage.

7. The fluid passage of claim 6 wherein the bolts have an inside surface and characterized in that the holes contact the bolts at the inside surface thereof.

8. The fluid passage of claim 6 characterized in that said interconnection passage connects to the outer extent of two of the holes.

9. The fluid passage of claim 6 characterized by the addition of an internal area, said internal area extending off of at least one of the holes towards the axial center of the manifold.

10. The fluid passage of claim 6 characterized in that the manifold is of multi-plate construction with said interconnection passage in at least two plates.

11. The fluid passage of claim 10 characterized in that said interconnection passages overlap between plates.

12. The fluid passage of claim 11 characterized in that said interconnection passages include some overlapping through all plates of the manifold.

13. The fluid passage of claim 6 wherein the device has a passage in the housing to a port and characterized by the passage to the port being located between two of the bolt holes, a groove, said groove being in the housing and said groove connecting the passage to said two bolt holes.

14. The fluid passage of claim 13 wherein the housing includes a wear plate and characterized in that said groove is in the wear plate.

15. A fluid passage of claim 6 characterized in that said interconnection passage connects two holes, and said two holes being adjacent.

16. A fluid passage for a manifold having bolts extending through holes therein, the fluid passage comprising the holes surrounding the bolts, the holes having an outer edge respectively, said outer edge being extended radially of the bolts, an interconnection passage, said interconnection passage connecting at least two of the holes, and the fluid passage including said interconnection passage.

17. The fluid passage of claim 16 wherein the bolts and holes have diameters and characterized in that the diameter of the holes is greater than the diameter of the bolts.

18. The fluid passage of claim 16 characterized in that said interconnection passage connects the outer extent of said at least two of the holes.

19. The fluid passage of claim 16 characterized in that the outer edge of a given hole is extended in both radial directions in respect to such given hole.

20. The fluid passage of claim 16 wherein the manifold has a surface confronting a valve and characterized by the addition of an internal area, said internal area extending in the surface of the manifold off of at least one of said holes towards the axial center of the manifold.

21. The fluid passage of claim 20 characterized in that said internal areas exist between two of the holes.

22. The fluid passage of claim 20 characterized in that said internal area extends between two of the holes.

23. The fluid passage of claim 16 characterized by the addition of a radially extended area, and said radially extended area extending off of one of said holes in the opposite direction as said interconnection passage.

24. A fluid passage of claim 16 characterized in that said interconnection passage connects two holes, and said two holes being adjacent.

25. In a hydraulic device having a valving opening to a gerotor cell in a surface adjacent to a stator roll with an end, the improvement of an extension, said extension being in the surface, said extension extending laterally off of the valving opening, next to the end of the stator roll connecting same to the valving opening.

26. In a hydraulic device having bolts and passages, the passages comprising an inner unidirectional passage, an out unidirectional passage, and a system of bi-directional channels, the improvement of the passages being located next to the bolts, said inner unidirectional passage being the central cavity, said outer unidirectional passage including the holes surrounding the bolts, and said system of bi-directional channels being located between said inner and outer unidirectional passages.

27. The improvement of the system of fluid passages of claim 26 characterized in that said outer unidirectional passage includes radially extended areas, said radially extended areas extending off of at least one hole surrounding a bolt.

28. The improvement of the system of fluid passages of claim 27 characterized in that there are two adjoining holes with radially extended areas and two radially extended areas of said two adjoining holes forming an interconnection passage connecting same.

29. The improvement of the system of fluid passages of claim 28 characterized in that said at least one hole has two radially extended areas and said two radially extended areas extending symmetrically in opposing radial directions.

30. The improvement of the system of claim 26 characterized in that said outer unidirectional passage including an internal area, said internal area extending off of at least one hole towards the axial center of the manifold.

31. The improvement of the system of claim 26 wherein the device includes a stator roll having an end and characterized in that said bi-directional channels have a valving opening, an extension, said extension being in the surface, said extension extending laterally off of the bi-directional channels respectively next to the end of the stator roll at the valving opening.

* * * * *